United States Patent [19]

Staib

[11] Patent Number: 4,519,588

[45] Date of Patent: May 28, 1985

[54] MOLTEN COPPER OXYGENATION APPARATUS

[75] Inventor: William G. Staib, Carrollton, Ga.

[73] Assignee: Southwire Company, Carrollton, Ga.

[21] Appl. No.: 633,330

[22] Filed: Jul. 23, 1984

Related U.S. Application Data

[62] Division of Ser. No. 510,091, Jul. 1, 1983, Pat. No. 4,469,518.

[51] Int. Cl.[3] ..... C21C 5/48

[52] U.S. Cl. ..... 266/220; 266/225

[58] Field of Search ..... 266/220, 225; 75/72–76

[56] References Cited

U.S. PATENT DOCUMENTS 3,743,500 7/1973 Foulard ..... 266/220

*Primary Examiner*—Peter D. Rosenberg

*Attorney, Agent, or Firm*—Herbert M. Hanegan

[57] ABSTRACT

In an in-line refining vessel (50) having one or more submerged porous plugs (20) for bubbling gasses through the molten metal (47) to stir the slag layer (46) covering same, an oxygen lance (40) for effectively oxygenating the melt from above. A plurality of such devices may be used in a single vessel.

4 Claims, 3 Drawing Figures

MOLTEN COPPER OXYGENATION APPARATUS

REFERENCE TO RELATED APPLICATION

This application is a division of my prior application Ser. No. 510,091, filed on July 1, 1983, now U.S. Pat. No. 4,469,518.

TECHNICAL FIELD

This invention relates to the metallurgical arts, and more particularly to copper refining metallurgy. Specifically, this invention relates to improvements in equipment for the oxygenation phase of in-line refining of molten copper metal.

BACKGROUND ART

Raw copper produced by smelting is frequently later electrolytically refined. For this reason, the molten copper product must be suitable for casting anodes. This makes it necessary to refine the copper sufficiently to remove substantial quantities of dissolved sulphur and oxygen in order to cast desirable anodes. If the metal were cast directly into anodes, the high level of sulphur (typically about 0.05%) and dissolved oxygen (typically about 0.5%) would combine to form $SO_2$ blisters in the cast metal. The purpose of in-line refining, as practiced with the present invention, is primarialy to remove sulphur from the molten copper. This is done in two steps: "blowing" and "poling". Blowing is the oxygenating step, wherein the sulphur is oxidized (to gaseous $SO_2$), lowering the sulphur level (to typically 0.003%) in the molten copper. Poling, the introducing of a hydrocarbon into the melt, minimizes the formation of copper oxide during solidification.

The present invention is directed to improvements in apparatus for the oxidation of molten copper. In this process for in-line copper refining, a stream of molten copper from a furnace is subjected to oxygenation as it passes through one of a series of vessels during a continuous refining process.

At first, experiments were attempted useing an oxygen lance similar to those used in the steel industry to direct gas onto the surface of the molten copper. Insufficient oxygenation resulted; due at least in part to a slag layer floating on the surface of the molten copper. The lance was generally incapable of penetrating the slag layer.

Another method of oxygenating the copper is by passing a stream of oxygen through a porous plug into the molten metal as shown, for example, by U.S. Pat. Nos. 3,904,180; 3,917,242; 3,972,709; or 4,277,381. An experimental arrangement was undertaken to determine the feasibility of using a porous plug to bubble oxygen into the molten copper while it flowed through the vessel, and over the porous plug, by gravity. When bubbling pure oxygen through the porous plug, the plug failed prematurely. Two failure modes were noted; in the first, the pure oxygen reacted with the hot steel case of the porous plug and the plug shell melted and failed. In the second failure mode, molten copper peneterated the porous plug and, combined with the first failure mode, molten copper leaked from the apparatus. It was found, however, that the plug did not fail if oxygen and nitrogen were mixed and bubbled through a copper sheathed porous plug fed with copper piping. Unfortunately, insufficient oxygenation of the molten copper still took place.

DISCLOSURE OF THE INVENTION

The present invention incorporates the modified copper sheathed porous plug and the use of a mixture of oxygen and nitrogen to stir the slag layer, during which stirring the oxygen lance is capable of effectively penetrating the slag layer from above. The result is a bubbling, or churning, of the molten copper stream sufficient to displace the slag layer on top of the molten copper, while also partially oxygenating the melt. With the slag layer dispersed, the oxygen lance is able to permeate the molten copper sufficiently to oxygenate it to the desired level.

For these and other reasons which may become apparent hereinafter, this invention therefore contemplates the use of an oxygen lance in combination with a less reactive gas passing through one or more porous plugs in oxygenation vessels forming a portion of an in-line copper refining apparatus. The porous plugs are copper sheathed where contacted with oxygen in order to reduce or eliminate the usual oxygen-steel reaction.

An object of this invention is to extend the life of porous plugs in oxygenation vessels.

Another object of this invention is to avoid premature plugging of such porous plugs, as by molten copper penetration.

Yet another object of the present invention is to eliminate oxygenation vessel downtime and maintenance expenses due to the need for frequent porous plug replacement.

And another object of the invention is the effective oxygenation of molten copper through the use of an oxygen lance for injecting oxygen into the molten copper.

BRIEF DESCRIPTION OF THE DRAWINGS

Other features and advantages of the invention disclosed herein will be apparent upon examination of the drawing figures forming a part hereof, in which the protective copper sheathed porous plug and oxygen lance apparatus is shown in more detail.

BEST MODE FOR CARRYING OUT THE INVENTION

Figure 1:
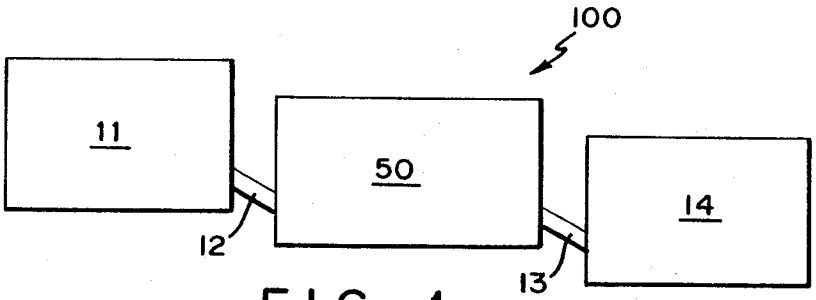
FIG. 1 schematically shows the location of the oxygenation vessel in a typical continuous in-line refining operation.

The present invention comprises improvements in an oxygenation vessel forming a part of an in-line refining operation 100, FIG. 1. The oxygenation vessel 50 is located along the in-line refining molten metal flow path between the furnace 11 and the reduction vessel 14. A first launder 12 conveys the molten metal to the oxygenation vessel 50, and a second launder 13 conveys the molten metal from the oxygenation vessel to the reduction vessel 14 from which anodes may be cast.

Figure 2:
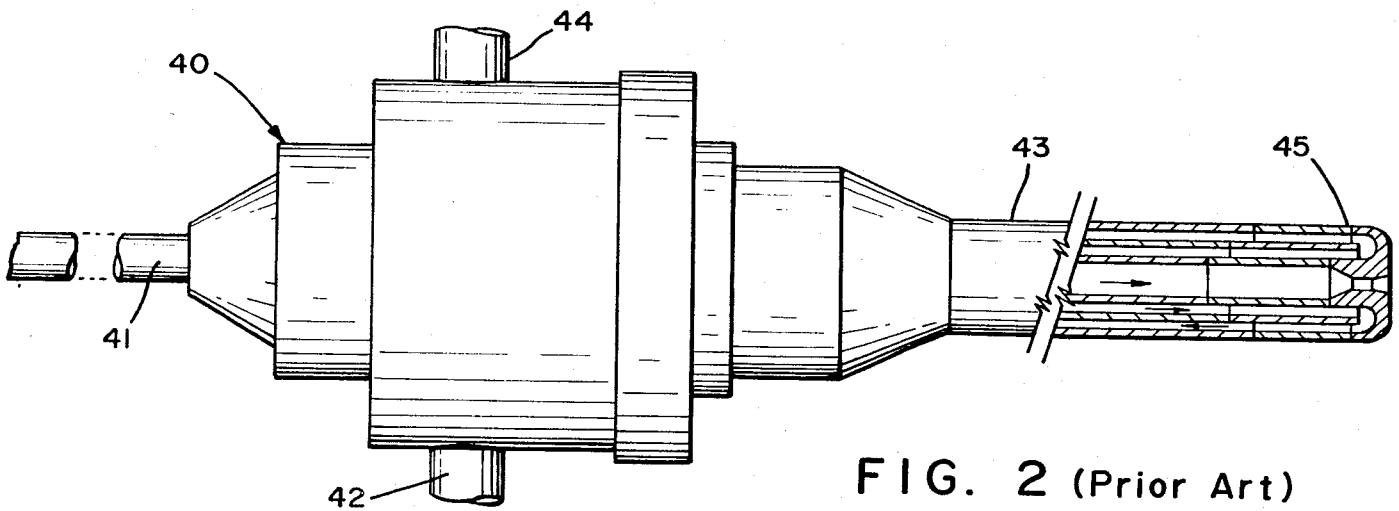
FIG. 2 (Prior Art)
FIG. 2 shows the oxygen lance including a partial cross section thereof, and FIG. 3. shows a side view of the oxygenation vessel with portions removed to permit showing the location of the porous plug and the oxygen lance of the invention.

FIG. 2 shows a conventional oxygen lance 40 as known in the steel industry. Lance tip 45 is directed toward the molten copper stream 47 which is covered by slag layer 46. Oxygen is supplied to the lance means 40 via pipe 41; water, for cooling, is provided by pipe 44 and directed through the walls of the lance shaft 43 and around the lance tip 45, then exhausted via pipe 42.

Figure 3:
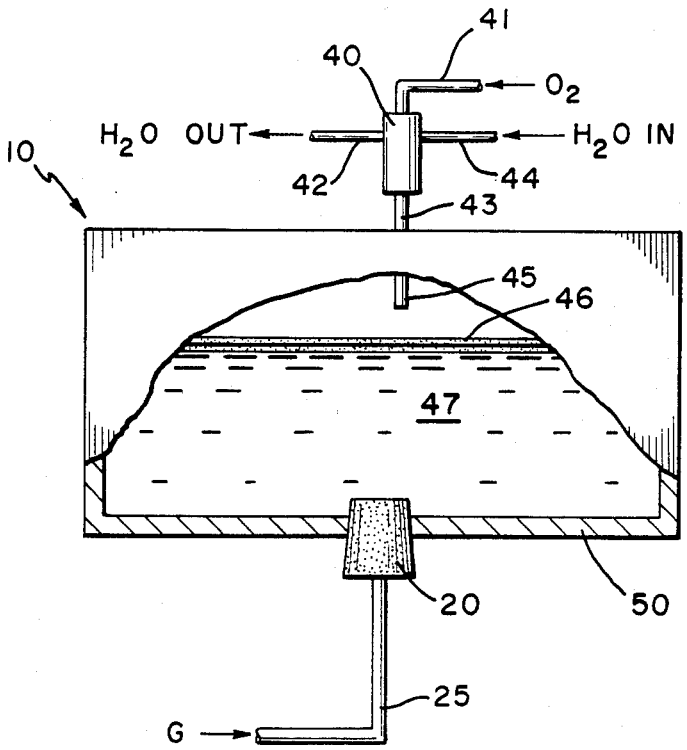

Turning now to FIG. 3, there is shown a cutaway view of the oxygenation vessel 50 revealing the present invention 10. A series of one or more molten copper impervious porous plugs 20 are attached to the bottom of the oxygenating vessel 50. Porous plug 20 is supplied with a gas mixture G (which may be oxygen or air mixed with other gasses, such as nitrogen) via supply pipe 25. The gas G flow through pipe 25 to porous plug 20 may be controlled by a valve (not shown). Porous plug 20 may be covered for protection until needed. Directly above the porous plug(s) is the lance described above.

Although only preferred embodiments of the invention are specifically illustrated and described herein, it will be understood that many modifications and variations of the inventive concept are possible in light of the foregoing teachings, and within the preview of the appended claims, without departing from the spirit and intended scope of the invention.

What is claimed is:

1. An improved vessel, for the oxygenation of a continuous stream of molten copper, of the type having an entrance launder for receiving a stream of molten metal from a furnace; top, bottom, and sides for containing the stream of the molten copper; and an exit launder for discharging treated molten copper to another vessel, wherein the improvement comprises the combination of a gas permeable molten copper impervious plug mounted in the bottom of said oxygenation vessel and in communication with a source of gas, and a lance mounted in said top directly above, and pointed toward, said plug and in communication with a source of oxygen.

2. Apparatus according to claim 1 in which all portions of the permeable plug which are made from steel and exposed to oxygen are coated to prevent direct oxygen contact with said steel portions.

3. Apparatus according to claim 2 in which the steel coating is copper.

4. Apparatus according to claim 2 in which said lance means is located directly above said permeable plug and adapted to direct oxygen at molten copper which has been stirred by said permeable plug.

* * * * *